US006533624B1

(12) United States Patent
Nanami et al.

(10) Patent No.: US 6,533,624 B1
(45) **Date of Patent: *Mar. 18, 2003**

(54) FOUR CYCLE LUBRICATING SYSTEM FOR WATERCRAFT

(75) Inventors: Masayoshi Nanami, Iwata (JP); Toshiyuki Hattori, Iwata (JP)

(73) Assignee: Yamaha Hatsudoki Kabushiki Kaisha, Iwata (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/157,076

(22) Filed: Sep. 18, 1998

Related U.S. Application Data

(62) Division of application No. 08/814,349, filed on Mar. 11, 1997, now abandoned.

(30) Foreign Application Priority Data

Mar. 12, 1996 (JP) ..... 8-55100

(51) Int. Cl.[7] ..... B63H 21/10
(52) U.S. Cl. ..... 440/88
(58) Field of Search ..... 440/38, 88; 114/55.5, 114/55.51, 55.52, 55.53; 123/196 R; 183/6.13

(56) References Cited

U.S. PATENT DOCUMENTS

| | | | | |
|---|---|---|---|---|
| 1,539,607 A | * | 5/1925 | Spring | 183/6.13 |
| 3,191,572 A | * | 6/1965 | Wilson | 440/38 |
| 4,133,284 A | * | 1/1979 | Holcroft | 440/88 |
| 4,151,823 A | * | 5/1979 | Grosse et al. | 123/196 A |
| 4,636,176 A | * | 1/1987 | Capilla | 440/12 |
| 4,689,028 A | | 8/1987 | Murase | |
| 4,768,983 A | * | 9/1988 | Smith | 114/55.5 |
| 4,915,070 A | | 4/1990 | Okui | |
| 4,986,777 A | | 1/1991 | Preston | |
| 5,037,340 A | * | 8/1991 | Shibata | 440/88 |
| 5,078,106 A | * | 1/1992 | Matsuo et al. | 123/196 R |
| 5,240,088 A | | 8/1993 | Okui et al. | |
| 5,405,276 A | | 4/1995 | Kato | |
| 5,490,474 A | | 2/1996 | Ikeda | |
| 5,511,505 A | | 4/1996 | Kobayashi et al. | |
| 5,558,549 A | | 9/1996 | Nakase et al. | |
| 5,572,943 A | | 11/1996 | Kobayashi et al. | |
| 5,634,832 A | | 6/1997 | Nakase et al. | |
| 5,640,936 A | * | 6/1997 | Hudson | 123/196 W |
| 5,732,672 A | * | 3/1998 | Nakase | 123/196 R |
| 5,839,930 A | * | 11/1998 | Nanami et al. | 440/88 |

OTHER PUBLICATIONS

P. 108 from "How to Rebuild Your Small Block Chevy" by David Vizard, HP Books, 1978.*

* cited by examiner

*Primary Examiner*—Ed Swinehart
(74) *Attorney, Agent, or Firm*—Knobbe, Martens, Olson & Bear, LLP

(57) ABSTRACT

A watercraft having a water propulsion unit driven by an impeller shaft which is powered by a four-cycle internal combustion engine is disclosed. The engine has a crankshaft which drives, via a transmission, the impeller shaft. The transmission is arranged so that the crankshaft of the engine does not contact lubricant in a lubricant reservoir of a lubricating system of the engine. In a first arrangement, the four-cycle engine includes an oil reservoir positioned at a lower portion of the engine. In this arrangement, a crankshaft of the engine extends along an axis above an axis along which the impeller shaft rotates, where the crankshaft and impeller shaft are in driving relation via a gear-type transmission. In a second arrangement, the engine is provided with a dry-sump type lubricating system with an oil reservoir positioned remote of the bottom of the engine, such as on the hull. In this arrangement, the engine is positioned adjacent the bottom of the watercraft, and the crankshaft extends in alignment with the impeller shaft.

35 Claims, 11 Drawing Sheets

FOUR CYCLE LUBRICATING SYSTEM FOR WATERCRAFT

CROSS REFERENCE TO RELATED APPLICATION

This application is a division of our co-pending application of the same title, Ser. No. 08/814,349, filed Mar. 11, 1997 and signed to the assignee hereof, now abandoned.

FIELD OF THE INVENTION

The present invention relates to a lubricating system for an internal combustion engine. More particularly, the present invention relates to a four-cycle engine for use in powering a water propulsion device of a watercraft, and a lubricating system for the engine.

BACKGROUND OF THE INVENTION

Two-cycle engines are used to power watercraft, including smaller watercraft known as "personal" watercraft. These engines have the advantage that they are fairly powerful, and relatively lightweight and compact.

One particular disadvantage to the two-cycle engine is its emission content. Two-cycle engines exhaust large quantities of carbon monoxide (CO) and various hydrocarbons. When measures are taken to reduce the emission content of the two-cycle engine, other generally undesirable consequences result, such as an increase in the weight of the engine, a reduction of its power output or the like.

Four-cycle engines are commonly used as a power plant in other applications, such as automobiles. These engines have the advantage that their emission content is desirably lower and the engines have a high power output.

On the other hand, four-cycle engines are generally arranged with oil-filled crankcases or reservoirs positioned at the bottom of the cylinder block. This impedes use of the four-cycle engine in this type of watercraft. In particular, when this type of engine is mounted in a watercraft in a manner in which the drive shaft is generally horizontally extending, the drive shaft must be elevated well above the hull of the watercraft in order to accommodate the oil reservoir extending below the engine.

At the same time, it is desirable for the impeller shaft which drives the water propulsion device for the watercraft to be positioned along the hull of the watercraft. If the propulsion device is raised upwardly, or if the impeller shaft is angled, the efficiency of the water propulsion device decreases dramatically. This causes a decrease in water propulsion force. Thus, when the standard four-cycle engine is mounted in a watercraft, the drive shaft is oriented in a manner incompatible with the impeller shaft of the propulsion unit.

It is desired to provide a watercraft with a four-cycle engine for powering a generally horizontally extending impeller shaft where the engine is supplied with adequate lubrication, and yet the propulsion efficiency of the watercraft's propulsion unit, remains high.

SUMMARY OF THE INVENTION

In accordance with the present invention, an arrangement is provided whereby a watercraft may be powered by a four-cycle internal combustion engine and still retain high propulsion efficiency. In each arrangement, a crankshaft of the engine is in driving relation with an impeller shaft which drives a water propulsion device of the watercraft.

Preferably, the water propulsion device comprises a water propulsion passage having an inlet and outlet and extending through a hull of the watercraft, with an impeller positioned in the passage for expelling water out the outlet.

In accordance with the present invention, the four-cycle engine is arranged so that the crankshaft thereof is interrelated with the lubricating oil reservoir so that the crankshaft does not contact the lubricant in the oil reservoir during the running of the engine.

In the presently preferred arrangement, the four-cycle engine is provided with a dry-sump type lubricating system. In this arrangement the oil reservoir is provided at a location other than the bottom of the engine, whereby the engine may be oriented so that the crankshaft extends along an axis near the bottom of the hull. The crankshaft extends along the same axis which the impeller shaft extends, with the impeller shaft and crankshaft in driving relation.

Further objects, features, and advantages of the present invention over the prior art will become apparent from the detailed description of the drawings which follows, when considered with the attached; figures.

DETAILED DESCRIPTION OF THE PREFERRED EMBODIMENTS OF THE INVENTION

Figure 1:
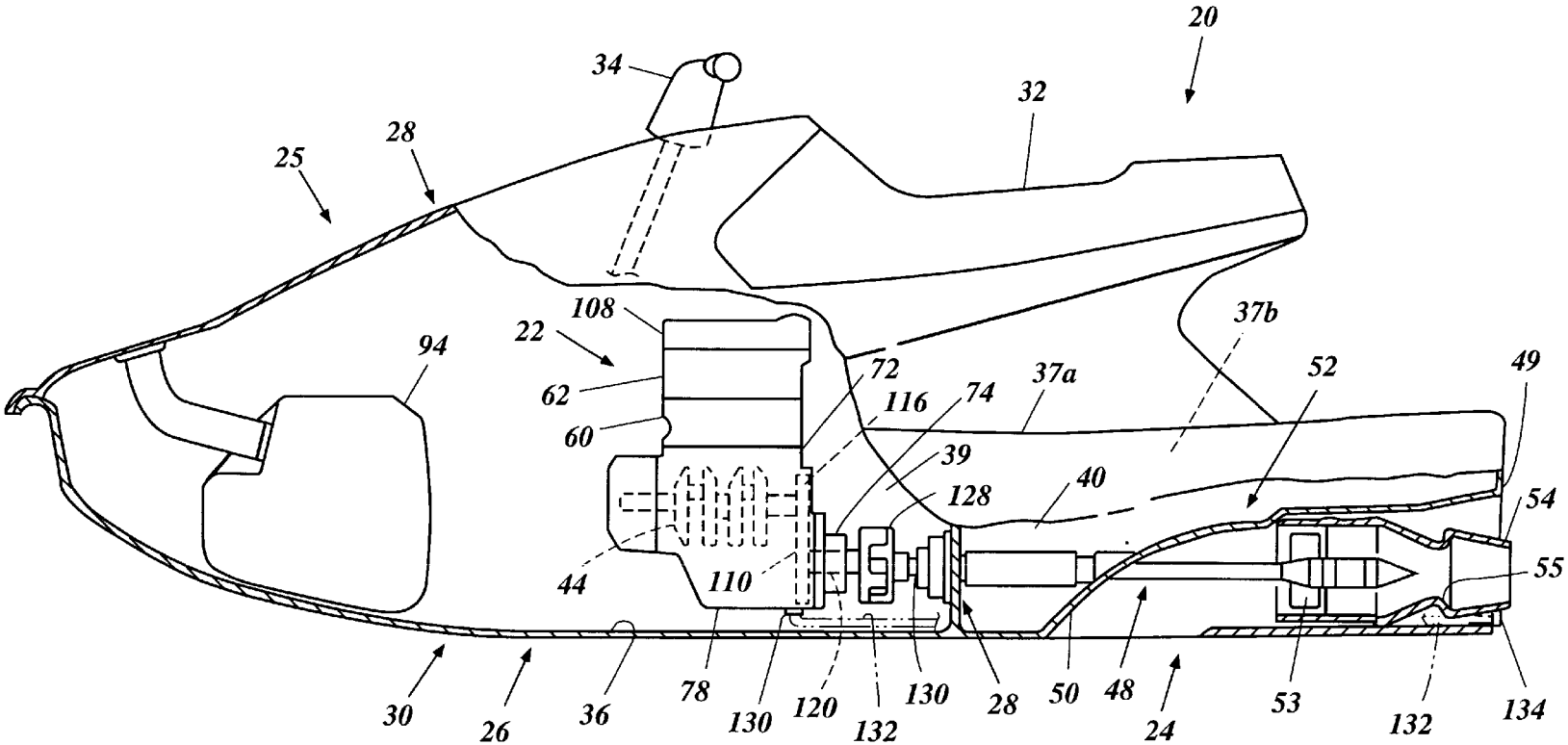
FIG. 1 is a side view, in partial cross-section, of a watercraft having an engine with a lubricating system in accordance with a first embodiment of the present invention.

FIG. 1 illustrates a personal watercraft 20 powered by an engine 22 having a lubricating system and otherwise arranged in accordance with the present invention. As illustrated therein, the watercraft 20 is of the jet propulsion type wherein the watercraft sucks in water through an intake and ejects it rearward. The watercraft 20 includes a propulsion unit 24 for propelling the water, the propulsion unit powered by the engine 22.

In general, the watercraft 20 includes a watercraft body 25. The watercraft body 25 includes a hull 26 comprising a top deck or lid 28 engaging a lower portion 30. A seat 32 is positioned on the top portion 28 of the hull 26. In addition, the watercraft body 25 includes a steering handle 34 is provided adjacent the seat 32 for use by a user in directing the watercraft 20. The lower portion 30 of the hull 26 has a bottom portion 36. Preferably, a pair of steps 37*a,b* are provided on opposite sides of the seat 32.

The top and lower portions 28,30 of the hull 26, along with a bulkhead 38, define an engine compartment 39 and a pumping chamber 40 The engine 22 is positioned in the engine compartment 39. As best illustrated in FIG. 2, the engine 22 is connected to the lower portion 30 of the hull 26 via several engine mounts 42.

In general, the engine 22 has a crankshaft 44 which is in driving relation with an impeller shaft 48. The impeller shaft 48 rotationally drives a means for propelling water of the propulsion unit 24, which unit extends out a stern portion 49 of the watercraft 20.

The propulsion unit 24 includes a propulsion passage 52, in which is located the means for propelling water. Preferably, this means comprises an impeller 53. The propulsion passage 52 has an intake port 50 which extends through the lower portion 30 of the hull 28. At the opposite end of the passage 52 there is positioned a nozzle 54. The nozzle 54 is mounted for movement up and down and to the left and right, whereby the direction of the propulsion force for the watercraft 20 may be varied. The nozzle 54 includes a tapered nozzle portion 55 through which water propelled by the impeller 53 passes, for increasing the velocity of the water.

Figure 2:
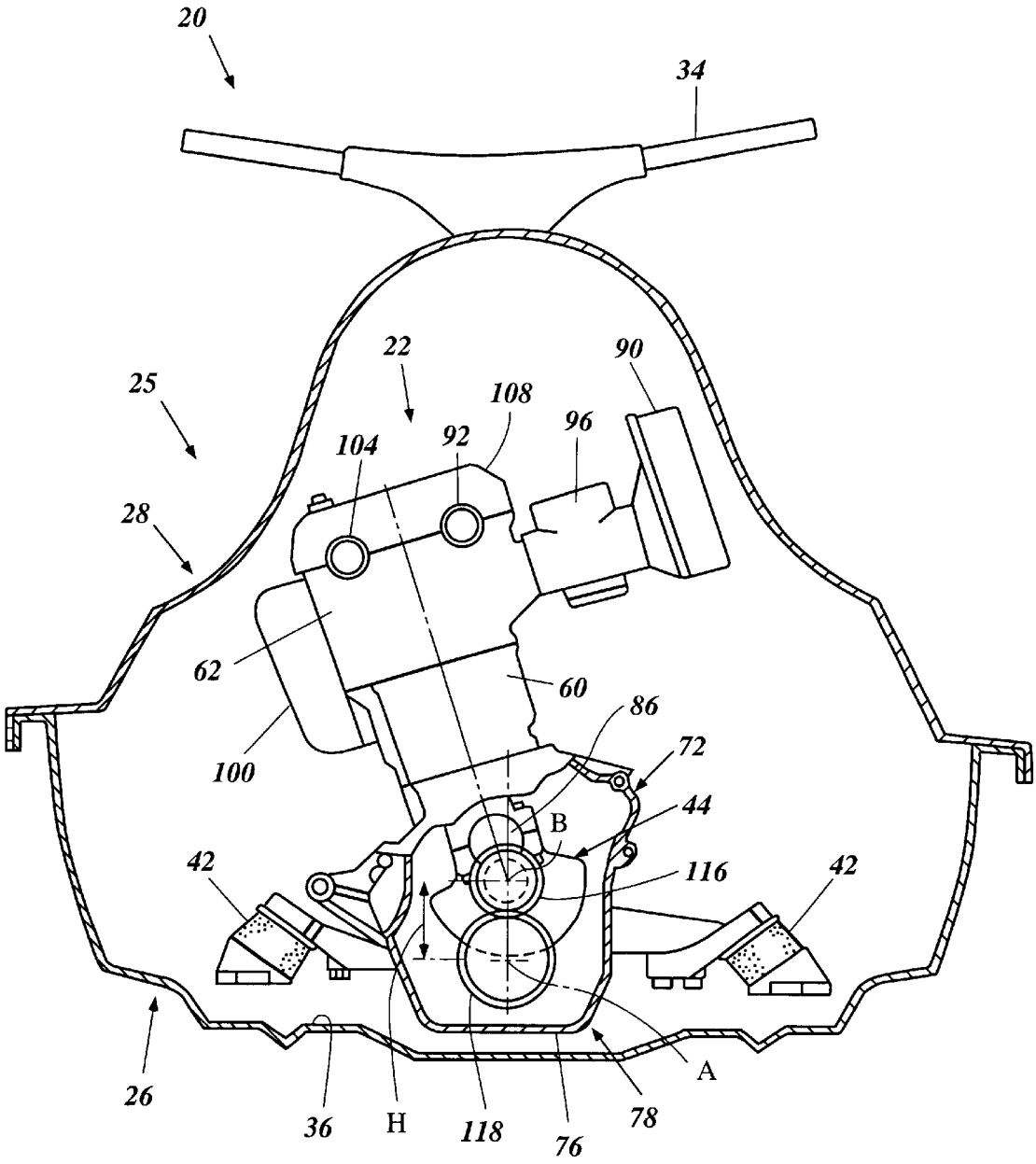
FIG. 2 is a cross-sectional end view of the watercraft illustrated in FIG. 1.
Figure 3:
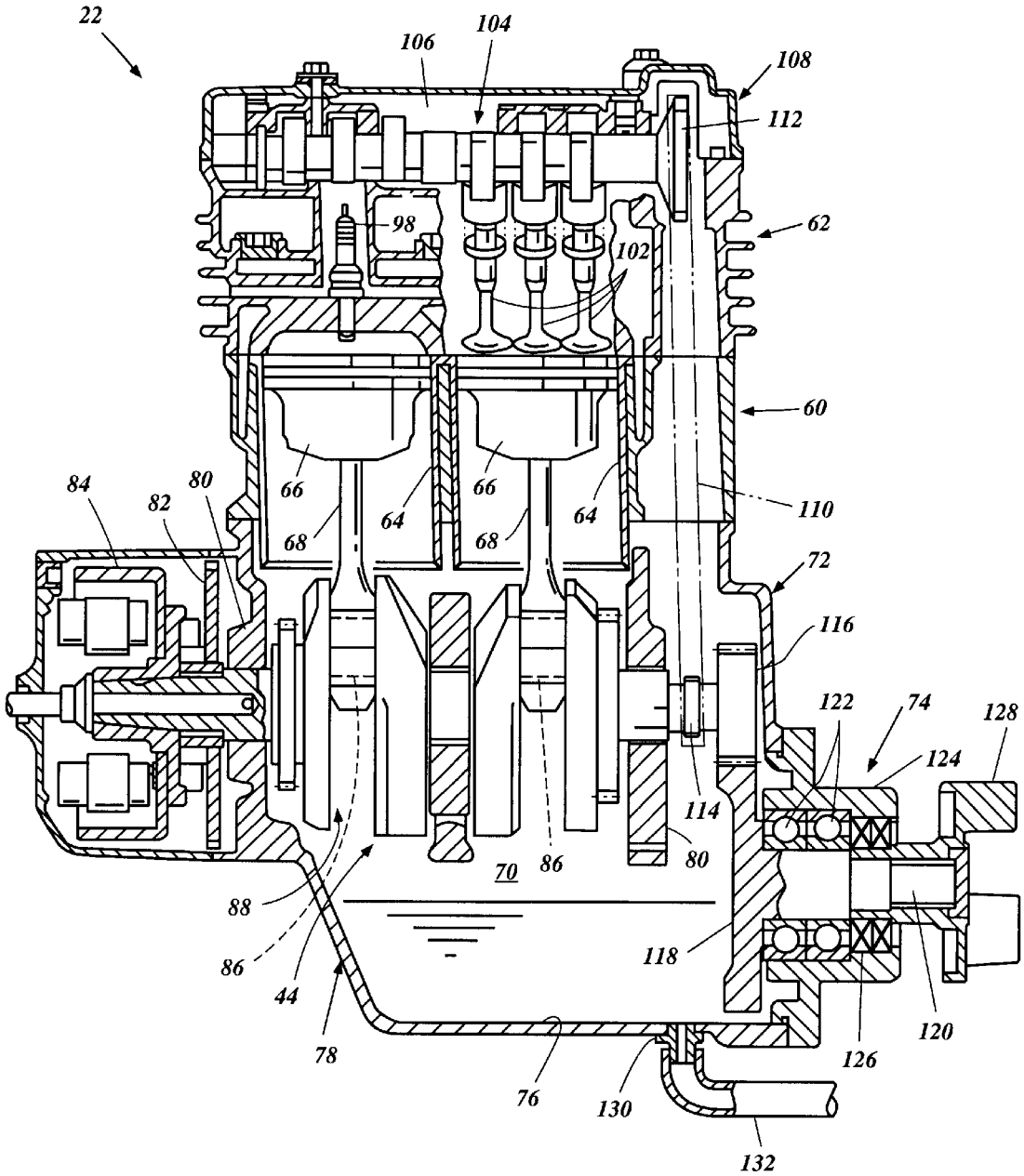
FIG. 3 is a cross-sectional side view of the engine of the watercraft illustrated in FIG. 1.

The engine 22 is best illustrated in FIGS. 1–3. As illustrated therein, the engine 22 is preferably of the two-cylinder, four-cycle variety. Of course, the engine 22 may have as few as one, or more than two, cylinders, as may be appreciated by one skilled in the art.

The engine 22 includes a cylinder block 60 having a cylinder head 62 connected thereto and cooperating therewith to define two combustion chambers 64. A piston 66 is movably mounted in each cylinder, and connected to the crankshaft 44 via a connecting rod 68. The crankshaft 44 is rotatably journalled with respect to the cylinder block 60 within a crankcase chamber 70. Preferably, the chamber 70 is defined by a crankcase member or cover 72 which extends from a bottom portion of the cylinder block 60, and a drive housing portion 74 of the crankcase cover. The crankcase member 72 has a bottom wall 76 which defines an oil reservoir 78. In addition, the crankcase member 72 has a pair of support walls 80 with respect to which the crankshaft 44 is rotatably journalled.

A toothed or cogged starter gear 82 is positioned on a front end of the crankshaft 44 extending through a front of the support walls 80. In addition, a flywheel 84 having magnets mounted thereon for use in a pulser-coil arrangement is provided on the crankshaft 44 adjacent the starter gear 82.

The crankshaft 44 preferably includes connecting pin portions 86 to which the connecting rods 68 are connected. The connecting pin portions 86 extend between counterweight portions 88 of the crankshaft.

The engine 22 includes means for providing an air and fuel mixture to each combustion chamber 64. Preferably, air is drawn into the engine compartment 39 through one or more air inlets (not illustrated) in the hull 26. As best illustrated in FIG. 2, air is then drawn into an air intake 90 to an air intake passage leading to each combustion chamber 64. Preferably, the flow of air into each combustion chamber 64 is regulated by at least one intake valve (not shown), as is well known to those skilled in the art. The intake valves are operated by an intake camshaft 92.

Preferably, fuel is provided to each combustion chamber 64 with the incoming air. In particular, fuel is drawn from a fuel tank 94 positioned in the engine compartment 39, by a fuel pump (not shown), and delivered to a carburetor 96. A throttle control (not shown) is preferably provided for allowing the watercraft operator to control the rate of fuel and air delivery to the engine 22 for controlling the speed and power output of the engine.

It is contemplated that the fuel may be provided by indirect or direct fuel injection, as well as via carburation, as known in the art.

A suitable ignition system is provided for igniting the air and fuel mixture provided to each combustion chamber 64. Preferably, this system comprises a spark plug 98 corresponding to each combustion chamber 64. The spark plugs 98 are preferably fired by a suitable ignition system, which includes the pulser-coil for use in setting the firing timing, as is well known to those skilled in the art.

Exhaust gas generated by the engine 22 is routed from the engine to a point external to the watercraft 20 by an exhaust system as is well known in the art, which system preferably includes an exhaust manifold 100. Exhaust from each combustion chamber 64 is preferably expelled from the combustion chamber to the exhaust manifold 100 through three exhaust passages (not shown). Means are provided for controlling the flow of exhaust gases through these exhaust passages. Preferably, this means comprises an exhaust valve 102. The exhaust valves 102 are actuated by a common exhaust camshaft 104.

The intake and exhaust camshafts 92,104 are mounted for rotation with respect to the cylinder head 62. The camshafts 92,104 are positioned within a camshaft chamber 106 formed by a camshaft cover 106 connected to the cylinder head 62.

Means are provided for rotating the camshafts 92,104 to effectuate movement of the intake and exhaust valves. Preferably, this means comprises a timing belt 110 which extends about a camshaft sprocket 112 positioned on an end of each camshaft 92,104, and a drive pulley 114 mounted on the crankshaft 44.

As stated above, the crankshaft 44 drives the impeller 53 of the propulsion unit 24. Means are provided for placing the crankshaft 44 in driving relation with the impeller shaft 48. This means preferably comprises a transmission comprising meshing gears 116,118 and a drive shaft 120. In particular, the end of the crankshaft 44 opposite the flywheel 84 has an output gear 116 mounted thereon. The output gear 116 is, in turn, in driving engagement with a drive gear 118 which is mounted on an end of the drive shaft 120 positioned within the crankcase chamber 70.

As best illustrated in FIG. 3, the drive shaft 120 is journalled for rotation with respect to the drive housing 74 portion of the crankcase cover 72 by a pair of bearings 122, and extends from the crankcase chamber 70. The bearings 122 are mounted in a generally circular flange portion 124 of the drive housing 74. At least one seal 126 is positioned adjacent the bearings 122 and about the drive shaft 120 for sealing the lubricating oil within the oil reservoir 78 portion of the crankcase.

As best illustrated in FIG. 2, the crankshaft 44, and the output gear 116 connected thereto, rotate about a generally horizontally extending axis B. On the other hand, the impeller shaft 48 and drive shaft 120 and the drive gear 118 connected thereto rotate about another generally horizontally extending axis A. These two axes A and B preferably lie in the same vertical place, but are separated in that plane by a distance H.

The end of the drive shaft 120 opposite the drive gear 118 is connected to an end 130 of the impeller shaft 48 via a coupling member 128. The coupling member 128 allows the impeller shaft 48 to be separated from the drive shaft 120 for convenient removal of the propulsion unit 24 or engine 22 without the other. By the coupling member 120, rotation of the drive shaft 120 effectuates rotation of the impeller shaft 48 for driving the impeller 53.

Figure 4:
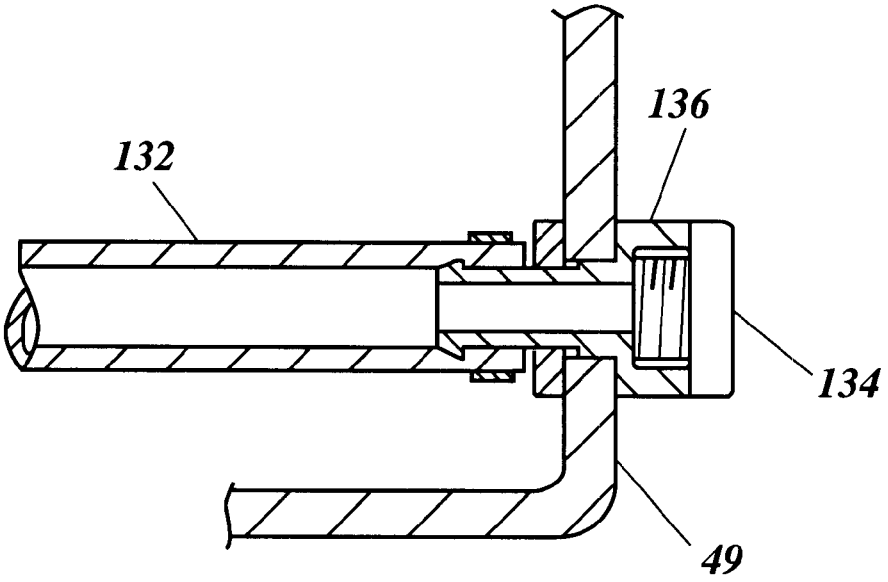
FIG. 4 is an enlarged view of a portion of a drain for the engine illustrated in FIG. 1.

As a further feature of the engine 22, a drain line is provided from the oil reservoir 78. As illustrated in FIGS. 1, 3 and 4, a drain fitting 130 is provided in the bottom wall 76 of the crankcase cover 72 forming the bottom of the oil reservoir 78. The fitting 130 includes a passages therethrough leading to a drain hose 132. The hose 132 extends rearwardly from the engine 22 along the bottom 36 of the hull 26 to a fitting 136 extending through the hull 26 at the stern 49. A cap 134 is selectively positionable in the fitting 136 for controlling the flow of liquid therethrough.

In the engine arrangement illustrated in FIGS. 1–4, a four-cycle engine is provided for powering the watercraft 20. The engine 22 is so arranged that the oil reservoir 78 is maintained at the bottom of the engine, and yet the propulsion unit 24 for the watercraft 24 also remains positioned along the bottom 36 of the hull 26, thereby maintaining optimum water propulsion efficiency.

FIGS. 5–9 illustrate a watercraft 120 powered by an engine 122 arranged in accordance with a second embodiment of the present invention.

As illustrated, the watercraft 120 is similar to the watercraft 20 described above, and includes a watercraft body 125 comprising a hull 126 having a top portion or deck 128 and a lower portion 130. A gunnel 127 defines the intersection of the hull 126 and the deck 128.

A front seat 132 and a rear seat 134 are positioned on the top portion 28 of the hull 26. The front seat 132 is preferably connected to a first removable deck member 136. The rear seat 134 is preferably connected to a second removable deck member 138. A steering handle 140 is provided adjacent the front seat 132 for use by a user in directing the watercraft 120.

A bulwark 142*a,b* extends upwardly along each side of the watercraft 120. A foot step area 144*a,b* is defined between each seat 132,134 and its adjacent bulwark 142*a,b*.

Figure 5:
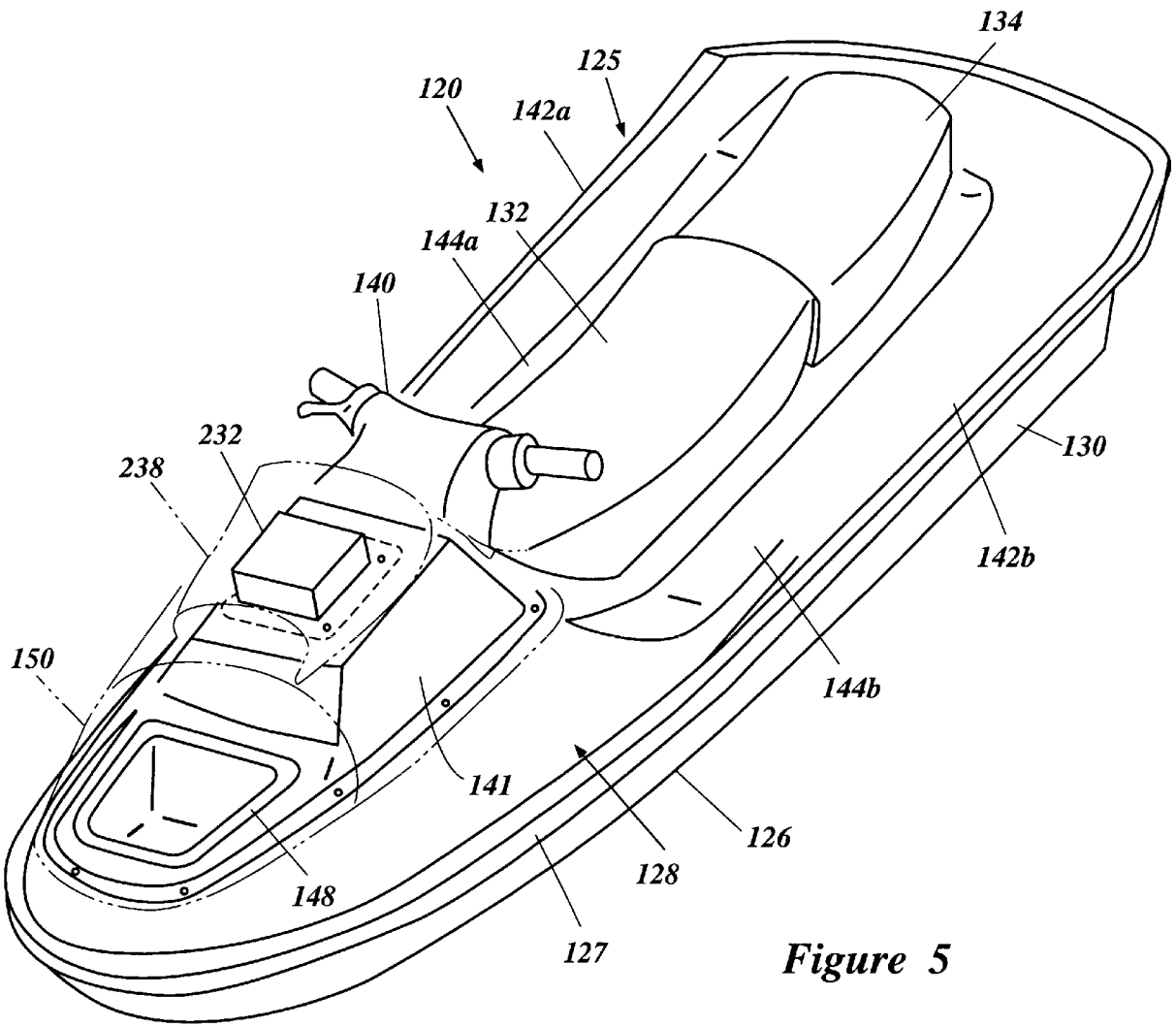
FIG. 5 is a perspective view of a watercraft powered by an engine having a lubricating system in accordance with a second embodiment of the present invention.

The watercraft 120 as illustrated in FIG. 5 includes a pair of storage boxes 146,148. A rear storage box 146 is preferably positioned underneath the rear seat 134 and is accessible by removing the second removable deck member 138. The front storage box 148 is preferably a recessed area in the top or lid portion 128 of the hull 126 at the bow of the craft, and includes a cover 150 selectively extendible over the storage box 148 for protecting the items therein from water and the like.

Figure 8:
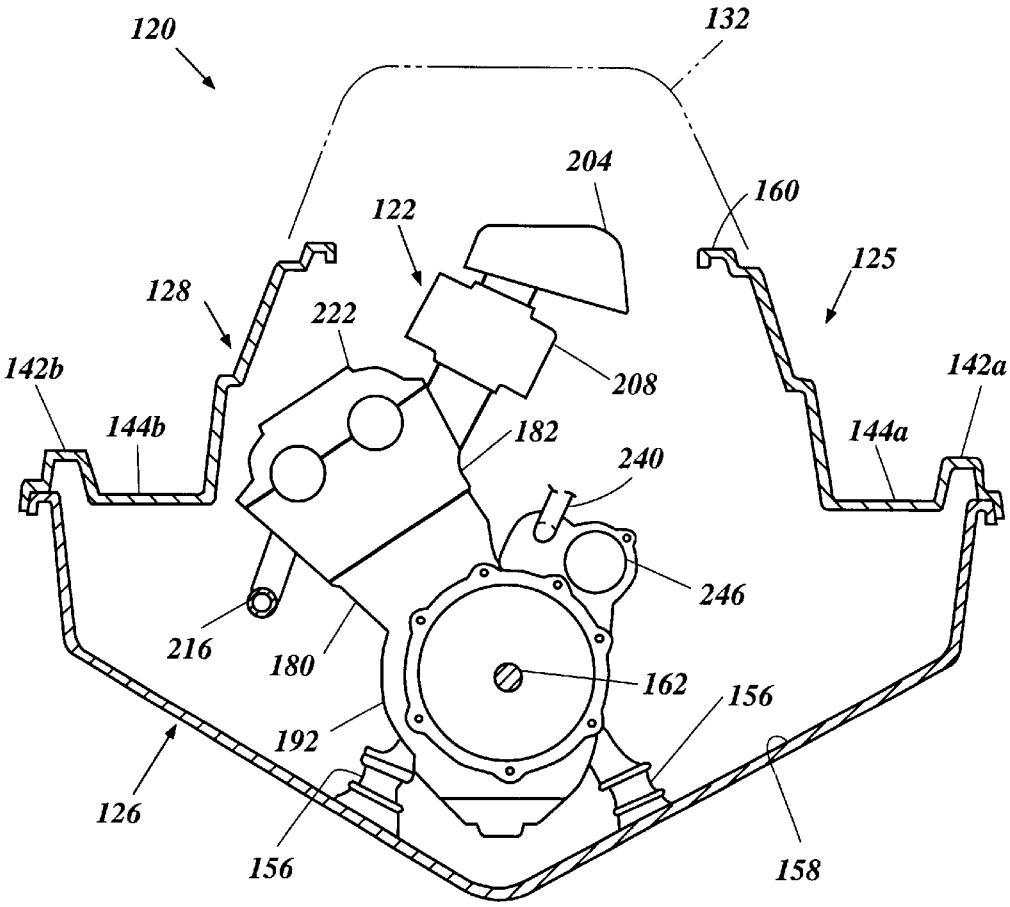
FIG. 8 is a cross-sectional end view of the watercraft illustrated in FIG. 5.

The top and bottom portions 128,130 of the hull 126, along with a bulkhead 152, define an engine compartment 154 and a pumping chamber 156. The engine 122 is positioned in the engine compartment 154. As best illustrated in FIG. 8, the engine 122 is connected to the hull 126 via several engine mounts 156 connected to a bottom 158 of the lower portion 130 of the hull 126. The engine 122 is preferably partially accessible through a maintenance opening 160 accessible by removing the first removable deck member 136 on which the front seat 132 is mounted.

The engine 122 has a crankshaft 162 which is in driving relation with an impeller shaft 164. The impeller shaft 164 rotationally drives a means for propelling water of the propulsion unit 124, which unit extends out a stem portion 166 of the watercraft 120.

The propulsion unit 124 includes a propulsion passage 170 having an intake port 168 which extends through the lower portion 130 of the hull 128. The means for propelling water, preferably an impeller 172 driven by the impeller shaft 164, is positioned in the passage 170. The passage 170 also has an outlet 174 is mounted within a chamber 176 and has its discharge positioned within a nozzle 178. The nozzle 178 is mounted for movement up and down and to the left and right, whereby the direction of the propulsion force for the watercraft 120 may be varied.

Figure 6:
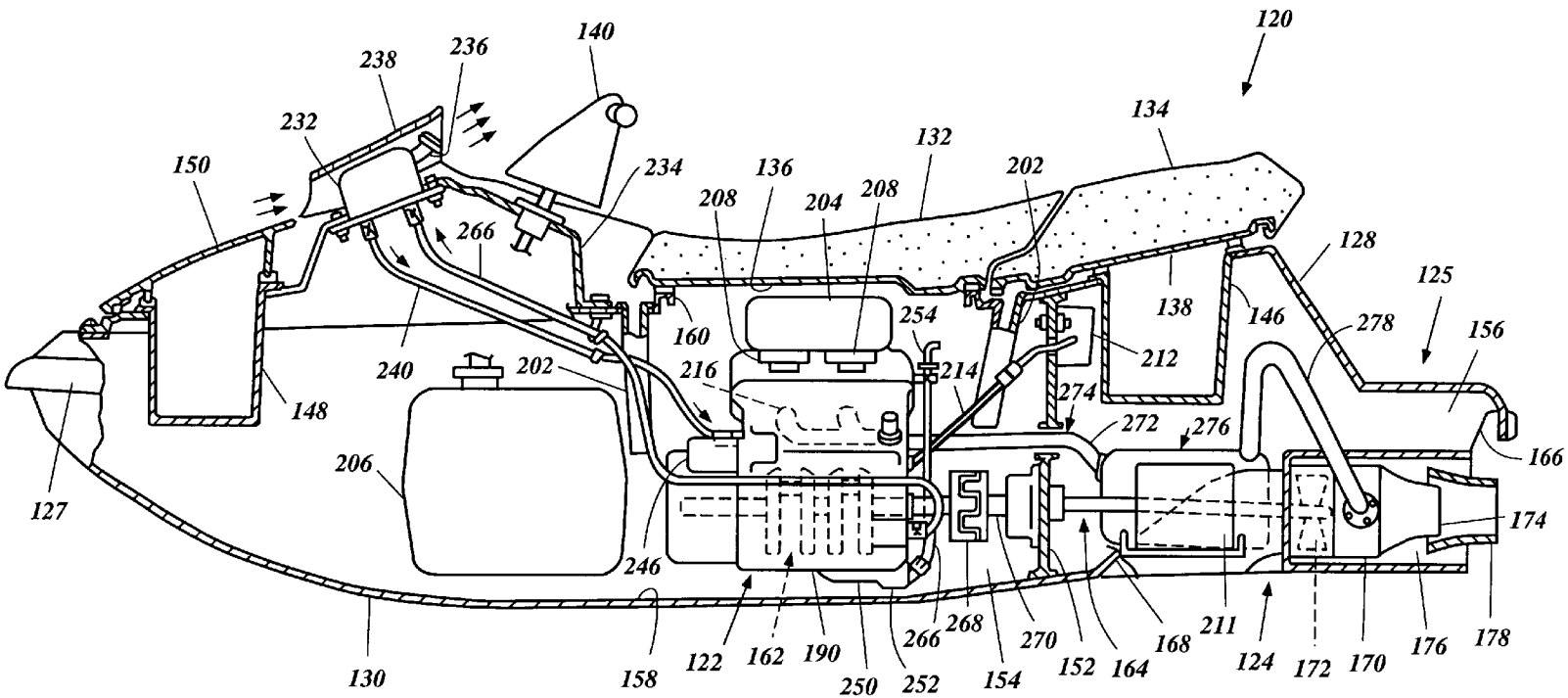
FIG. 6 is a cross-sectional side view of the watercraft illustrated in FIG. 5, illustrating the engine.
Figure 7:
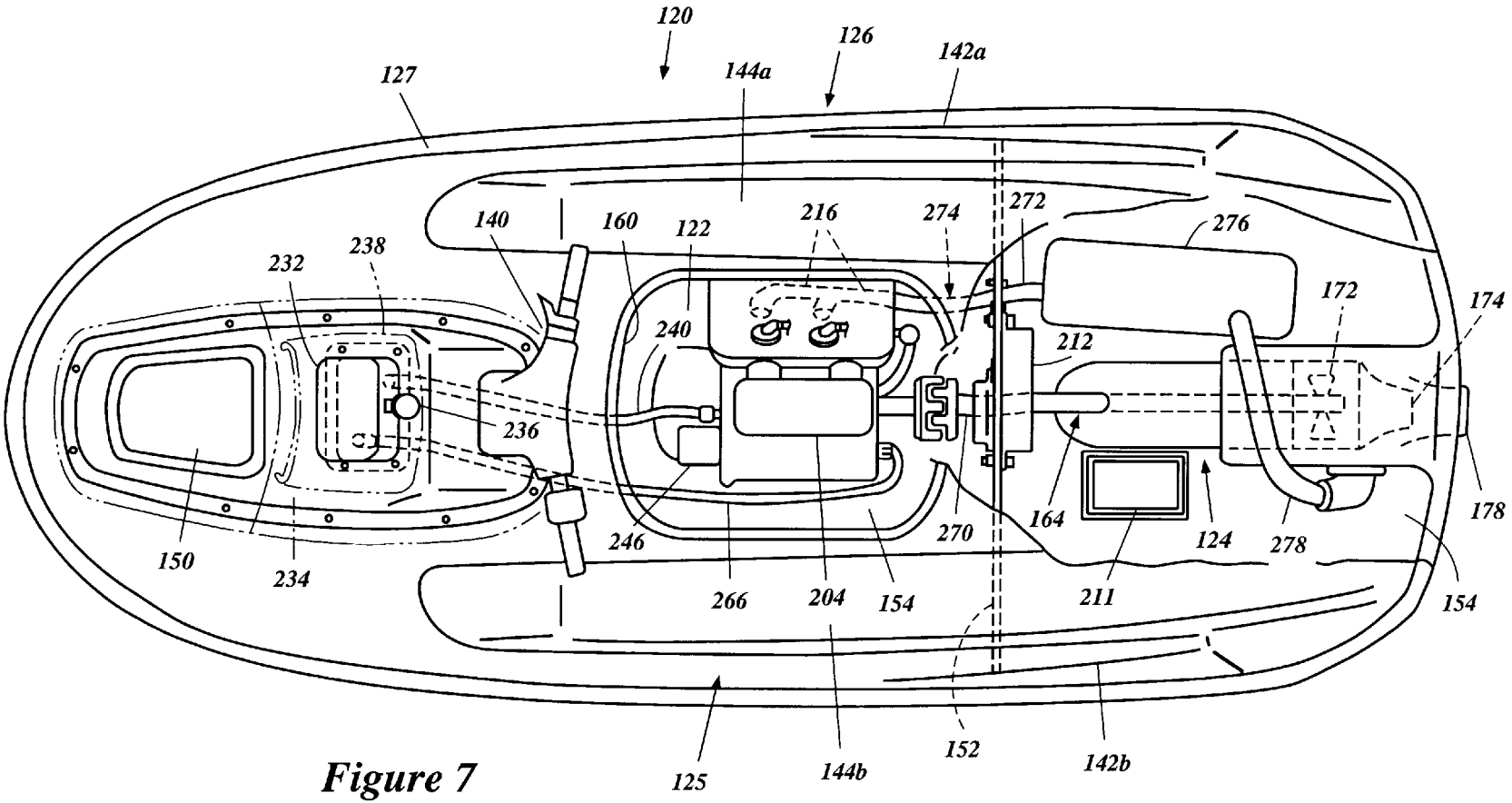
FIG. 7 is a top view of the watercraft illustrated in FIG. 7, with a top deck portion thereof cut way.
Figure 9:
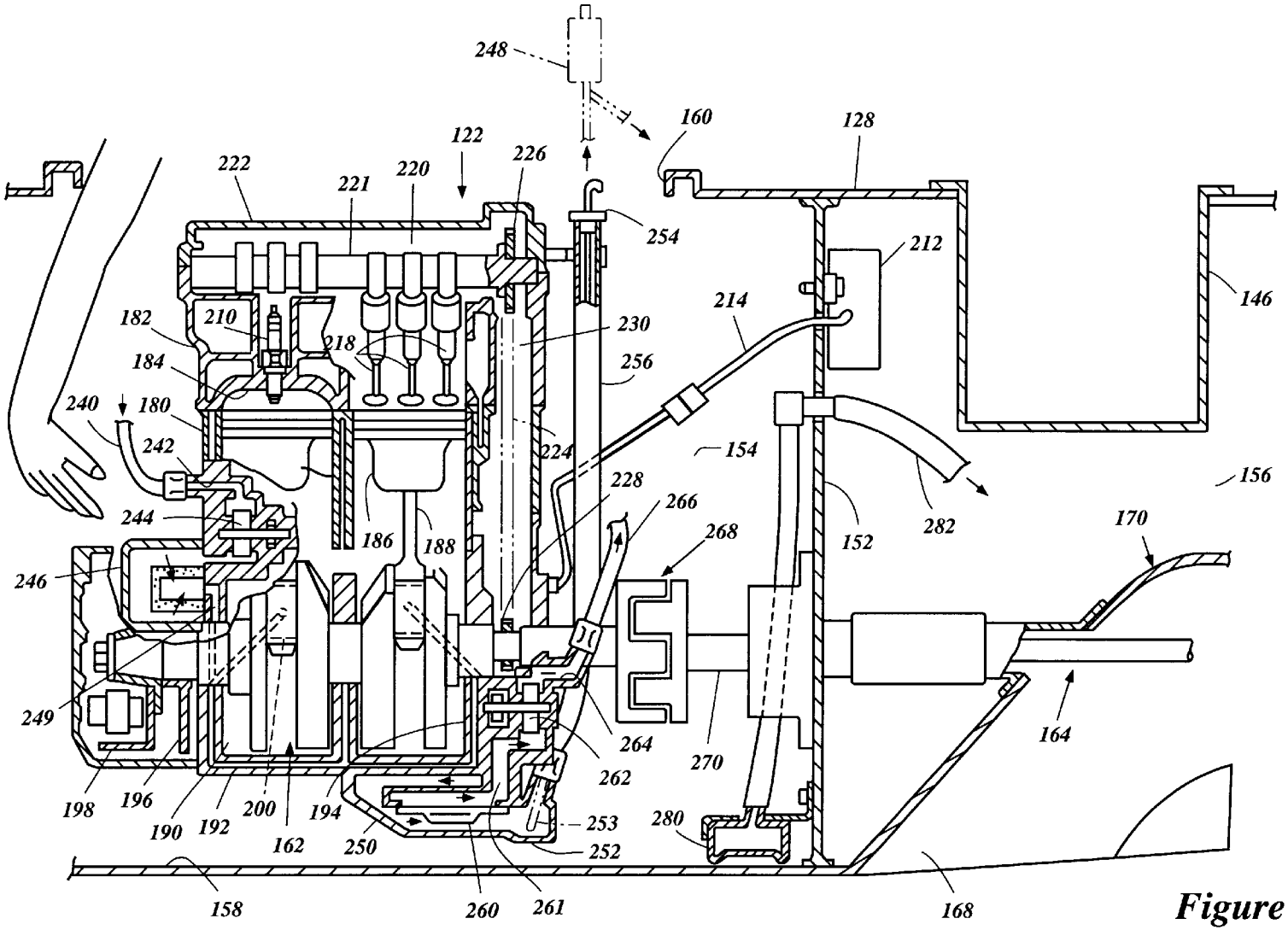
FIG. 9 is a across-sectional view of the engine illustrated in FIG. 6.

The engine 122 is best illustrated in FIGS. 6 and 9. As illustrated therein, the engine 122 is preferably of the two-cylinder, four-cycle variety. Of course, the engine 122 may have as few as one, or more than two, cylinders, as may be appreciated by one skilled in the art.

The engine 122 includes a cylinder block 180 having a cylinder head 182 connected thereto and cooperating therewith to define two combustion chambers 184. A piston 186 is movably mounted in each cylinder, and connected to the crankshaft 162 via a connecting rod 188.

The crankshaft 162 is rotatably journalled with respect to the cylinder block 180 within a crankcase chamber 190. Preferably, the chamber 190 is defined by a crankcase cover member 192 which extends from a bottom portion of the cylinder block 180. In addition, the crankcase member 190 has a number of support walls 194 with respect to which the crankshaft 162 is rotatably journalled.

A toothed or cogged starter gear 196 is positioned on a front end of the crankshaft 162 extending through a front of the support walls 194. In addition, a flywheel 198 is provided which preferably has one or more magnets thereon for use in a pulser-coil arrangement. The flywheel 198 is provided on the crankshaft 162 adjacent the starter gear 196.

The crankshaft 162 preferably includes connecting pin portions 200 to which the connecting rods 188 are connected. The connecting pin portions 200 extend between counterweight portions of the crankshaft, as is well known in the art.

The engine 122 includes means for providing an air and fuel mixture to each combustion chamber 184. Preferably, air is drawn into the engine compartment 154 through a pair of air inlets 202 in the hull 126, as illustrated in FIG. 6. Air is then drawn into an air intake 204 to an air intake passage leading to each combustion chamber 184. Preferably, the flow of air into each combustion chamber 184 is regulated by at least one intake valve (not shown), as is well known to those skilled in the art. The intake valves are operated by an intake camshaft (not shown).

Preferably, fuel is provided to each combustion chamber 184 with the incoming air. In particular, fuel is drawn from a fuel tank 206 positioned in the engine compartment 154, by a fuel pump (not shown), and delivered to a carburetor 208 positioned along each intake passage. A throttle control (not shown) is preferably provided for allowing the watercraft operator to control the rate of fuel and air delivery to the engine 122 for controlling the speed and power output of the engine.

It is contemplated that the fuel may be provided by indirect or direct fuel injection, as well as via carburation, as known in the art.

A suitable ignition system is provided for igniting the air and fuel mixture provided to each combustion chamber 184.

Preferably, this system comprises a spark plug 210 corresponding to each combustion chamber 184. The spark plugs 210 are preferably fired by a suitable ignition system, which preferably includes an electronic control 212 connected to the engine 122 by one or more electrical cables 214. Preferably, the pulser-coil generates firing signals for the ignition system. In addition, the ignition system may include a battery 211 for use in providing power to an electric starter and the like.

Exhaust gas generated by the engine 122 is routed from the engine to a point external to the watercraft 120 by an exhaust system which includes an exhaust manifold 216. Exhaust from each combustion chamber 184 is preferably expelled from the combustion chamber to the exhaust manifold 216 through three exhaust passages (not shown). Means are provided for controlling the flow of exhaust gases through these exhaust passages. Preferably, this means comprises an exhaust valve 218. The exhaust valves 218 are actuated by a common exhaust camshaft 220. The remainder of the exhaust system is disclosed in detail below.

The intake and exhaust camshafts are mounted for rotation with respect to the cylinder head 182. The camshafts are positioned within a camshaft chamber 221 formed by a camshaft cover 222 connected to the cylinder head 182.

Means are provided for rotating the camshafts to effectuate movement of the intake and exhaust valves. Preferably, this means comprises a timing belt 224 which extends about a camshaft sprocket 226 positioned on an end of each camshaft, and a drive pulley 228 mounted on the crankshaft 162. The timing belt 224 extends through a timing belt housing portion 230 of the engine 122.

The engine 122 includes a lubricating system for providing lubricating oil to the various moving parts thereof. An oil tank or reservoir 232 is provided separate from the engine. As illustrated in the embodiment in FIGS. 6 and 7, the reservoir 232 is connected to the outside of a hatch portion 234 of the hull 126. The reservoir 232 has a fill spout 236 and is preferably obscured under a visor 238 positioned just in front of the steering handle 140. As illustrated in FIG. 6, the oil reservoir 232 is positioned so that air passing along the top surface of the hull 126 passes under the visor 238 and around the reservoir, thereby cooling the oil therein.

An oil supply line or hose 240 extends from the reservoir 232 to a supply port 242 extending into the cylinder block 180. An oil pressure pump 244 is provided for pumping the oil through an oil filter 246, and then through the oil gallery, including a main gallery 249, of the engine 122.

The oil drains into an oil collector 250, which collector 250 is preferably separated, at least in part, from the crankshaft 162 by a divider such as a plate. The oil partially fills a pool area 252 at the end of the collector 250. An end 253 of a ullage rod 254 extending through a housing 256 allows the operator of the craft to determine if oil is being supplied to the engine.

Oil which is drawn into the collector 250 is subsequently drawn upwardly through a filter or screen 260 into a passage 261 leading to a return or scavenge pump 262. The return pump 262 delivers the oil through an outlet passage 264 and through a return hose or pipe 266 back to the oil reservoir 232.

The oil pumps 244,262 may be electrically or mechanically driven and of a type found suitable to those skilled in the art.

In the event the operator wishes to drain the oil from the engine 22, the ullage rod 254 is removed and an inlet line of a vacuum pump 248 is passed through the housing 256 into the collector 250.

As stated above, the crankshaft 162 drives the impeller 172 of the propulsion unit 124. In particular, the end of the crankshaft 162 extends through the crankcase cover 192 to a coupling 268, where it is coupled to a first end 270 of the impeller shaft 164.

As best illustrated in FIG. 6, the exhaust manifold 216 is connected to a first portion 272 of an exhaust pipe 274. The first portion 272 of the exhaust pipe 274 leads to a water lock 276, as well known in the art, and thereon to a second portion of the exhaust pipe 278. The second portion of the exhaust pipe 278 terminates in the chamber 176, where the exhaust gases from the engine 122 are discharged.

Preferably, the watercraft 120 includes a bilge 280 having a screened inlet positioned along the bottom 158 of the hull 126 within the engine compartment 154. A hose 282 leads from the bilge 280 for discharging water pumped from the engine compartment 154 from the watercraft 120.

This particular engine 122 has the advantage of being a four-cycle engine, but includes a "dry-sump" type lubricating system. This lubricating system eliminates the need for a deep oil reservoir under the engine 122. In this manner, the engine 122 may be mounted low enough to the bottom 158 of the hull 126 that the crankshaft 162 thereof may be coupled to the impeller shaft 164, with the impeller shaft 164 and crankshaft 162 extending along a common axis. Thus, the propulsion unit 124 may also remain close to the bottom as well, maintaining high propulsion efficiency.

Figure 10:
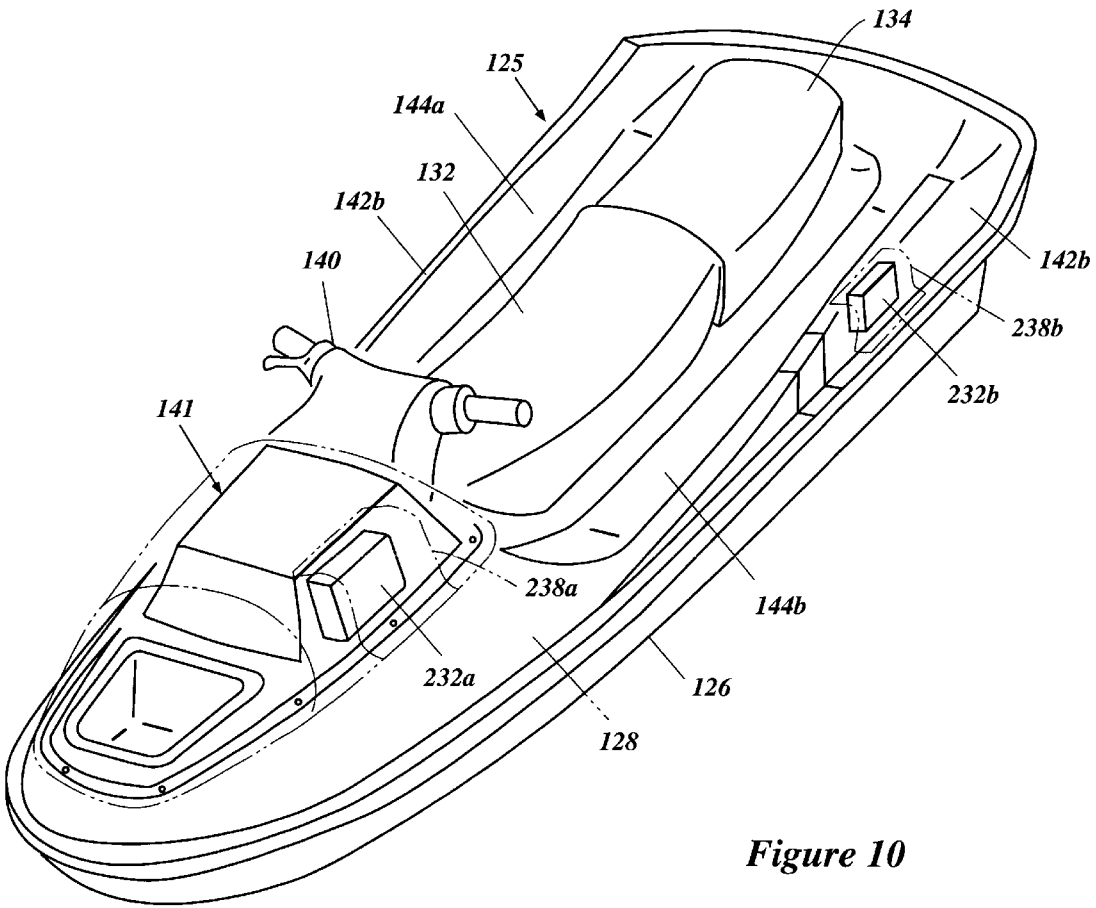
FIG. 10 is a perspective view of a watercraft powered by an engine having a lubricating system in accordance with a third embodiment of the present invention.

As best illustrated in FIG. 10, the oil tank 232 may be oriented in locations other than below a visor 238 directly in front of the steering handle 140. In a first alternate location, the oil tank 232*a* may be positioned along the downwardly sloping side of the hatch member 141, thus being offset from the steering handle 140. In this manner, air which is heated by the oil reservoir 232 is not directed into the watercraft operator's face. Preferably, a cover 238*a* partially extends over the oil reservoir 232*a*, the cover preferably having a front and rear end open to allow cooling air to flow around the reservoir.

In a second alternate location, the oil tank 232*b* is positioned on the bulwark 142*b* near the stern of the watercraft. This arrangement, like the last, prevents air heated by the .reservoir from being directed at the watercraft operator. A cover 238*b* is preferably provided over the oil reservoir 232*b*, the cover 238*b* having a front and rear end open to allow cooling air to flow therethrough.

Figure 11:
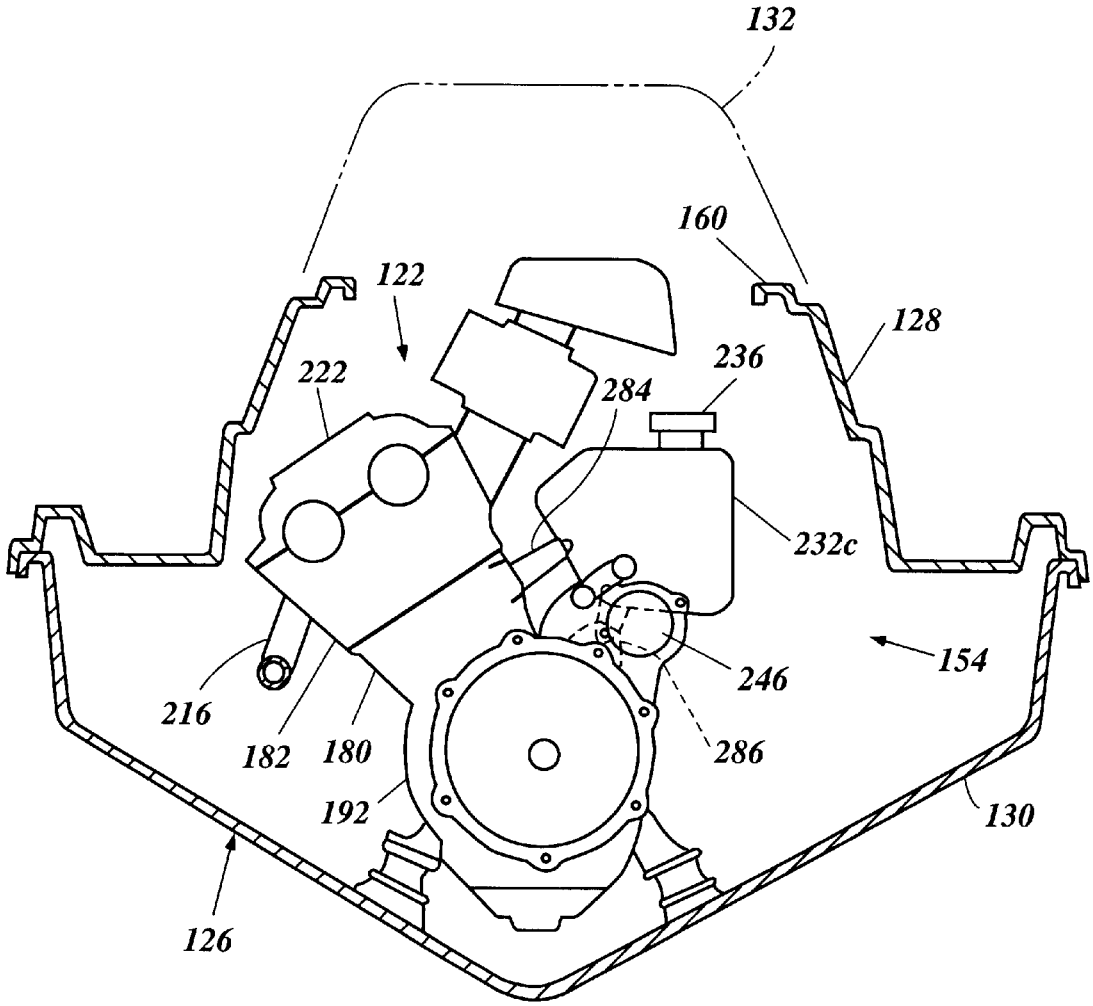
FIG. 11 is a cross-sectional end view of a watercraft powered by an engine having a lubricating system in accordance with a fourth embodiment of the present invention.

Lastly, in a third alternate location illustrated in FIG. 11, the oil tank 232*c* may be positioned within the engine compartment 154 and supported by the engine 122. In the arrangement illustrated, the oil reservoir 232*c* is connected to first and second supports 284,286 extending from the cylinder block 182.

All of the engine arrangements disclosed above have the advantage, in accordance with the present invention, that the output shaft of the engine remains close to the hull for driving the impeller shaft, and yet the engine is arranged so that the crankshaft does not contact the lubricating oil in the oil reservoir during the running of the engine. Thus, in as a first aspect of the invention, a four-cycle engine is arranged to drive the water propulsion apparatus of the watercraft in an optimum arrangement. Further, however, the engine is arranged so that the crankshaft does not interfere with the lubricating oil. Since the crankshaft does not encounter the oil in the oil reservoir, it does not throw the oil about and introduce air into it, which could interfere with the operation of the lubricating oil system.

Of course, the foregoing description is that of preferred embodiments of the invention, and various changes and modifications may be made without departing from the spirit and scope of the invention, as defined by the appended claims.

What is claimed is:

1. A watercraft having a hull, a water propulsion device supported by said hull, said hull defining a rider's area including a seat positioned on a raised portion on which a rider may sit in straddle fashion, and a four cycle internal combustion engine contained within said hull beneath said seat and said raised portion for powering said water propulsion device, said raised portion defining an opening above said engine through which said engine may be accessed when at least a portion of said seat is removed, said engine having a crankshaft for powering said water propulsion device rotatable about a crankshaft axis and within a crankcase chamber formed at a lower end of said engine, an oil reservoir for containing lubricant for said engine and supported by said hull independently of and at a location spaced longitudinally from the engine and the opening and at a location not accessible through the opening, and means for circulating lubricant from said oil reservoir through said engine for its lubrication and for returning the lubricant to said oil reservoir.

2. The watercraft in accordance with claim 1, wherein the oil reservoir is positioned within the hull.

3. The watercraft in accordance with claim 1, further including an oil collector positioned beneath the crankcase chamber into which the lubricant that has passed through the engine for its lubrication is collected for return to the oil reservoir.

4. The watercraft in accordance with claim 3, wherein the crankcase chamber and lubricant in the oil collector are separated, at least in part, by a dividing wall.

5. The watercraft in accordance with claim 1 wherein the water propulsion device comprises a propulsion passage having an inlet through which water is drawn through the hull, an outlet through which waters is expelled through said hull, a water propulsion device positioned in said passage for moving said water therethrough, and an impeller shaft connected to said water propulsion device at one end and to a drive shaft at its other end.

6. A watercraft having a hull, a deck portion connected to said hull, a water propulsion device supported by said hull and a four cycle internal combustion engine contained within said hull for powering said water propulsion device, said engine having a crankshaft for powering said water propulsion device rotatable about a crankshaft axis and within a crankcase chamber formed at a lower end of said engine, an oil reservoir for containing lubricant for said engine and supported on said deck portion at a spaced location from said engine, and means for circulating lubricant from said oil reservoir through said engine for its lubrication and for returning the lubricant to said oil reservoir.

7. The watercraft in accordance with claim 6, wherein the oil reservoir is positioned on the deck portion adjacent the hull.

8. The watercraft in accordance with claim 7 wherein the oil reservoir is positioned on the deck portion near a steering handle.

9. The watercraft in accordance with claim 6, wherein the oil reservoir is positioned at a side of a passenger's area.

10. A watercraft having a hull, a water propulsion unit supported by said hull, and a four cycle internal combustion engine contained within said hull for powering said water propulsion device, said water propulsion device comprising a propulsion passage having an inlet through which water is drawn through said hull, an outlet through which water is expelled through said hull, a water propulsion device positioned in said passage for moving said water therethrough, and an impeller shaft connected to said water propulsion device that one end and to a drive shaft at its other end, said engine having a crankshaft for powering said water propulsion device drive shaft rotatable about a crankshaft axis and within a crankcase chamber formed at a lower end of said engine, an oil reservoir for containing lubricant for said engine and supported by said hull independently of and at a location spaced longitudinally from said engine and positioned on said hull in a position where air will flow in proximity to said oil reservoir as the watercraft travels and means for circulating lubricant from said oil reservoir through said engine for its lubrication and for returning the lubricant to said oil reservoir.

11. A watercraft having a hull defining a rider's area including a seat positioned on a raised portion on which a rider may sit in straddle fashion, a water propulsion device supported by the hull, a four cycle internal combustion engine contained within the hull beneath the seat and the raised portion, the engine being configured to drive the water propulsion device, the raised portion defining an opening above the engine through which the engine may be accessed when at least a portion of the seat is removed, an oil reservoir to contain lubricant for the engine and supported by the hull independently of and at a location spaced longitudinally from the engine and the opening, the oil reservoir not being accessible through the opening, and a circulation system configured to circulate lubricant between the oil reservoir and the engine.

12. The watercraft in accordance with claim 11, wherein the oil reservoir is disposed on a bulwark of the hull.

13. The watercraft in accordance with claim 11 additionally comprising an oil collector positioned beneath the crankcase chamber and configured to collect lubricant which has passed through the engine for return to the oil reservoir.

14. The watercraft in accordance with claim 13, wherein the crankcase chamber and lubricant in the oil collector are separated, at least in part, by a dividing wall.

15. The watercraft in accordance with claim 11 wherein the water propulsion device comprises a propulsion passage having an inlet through which water is drawn through the hull, an outlet through which waters is expelled through the hull, a water moving device positioned in the passage and being configured to move the water therethrough, and an impeller shaft having first and second ends, the first end being connected to the water moving device and the second end being connected to a drive shaft.

16. A watercraft having a hull, a deck portion connected to the hull, a water propulsion device supported by the hull, a four cycle internal combustion engine supported by the hull and being configured to drive the water propulsion device, an oil reservoir configured to contain lubricant for the engine and being supported on the deck portion at a spaced location from the engine, and a circulation system configured to circulate lubricant from the oil reservoir through the engine and to return the lubricant to the oil reservoir.

17. The watercraft in accordance with claim 16, wherein the oil reservoir is positioned on the deck portion adjacent the hull.

18. The watercraft in accordance with claim 17, wherein the oil reservoir is positioned on the deck portion near a steering handle.

19. The watercraft in accordance with claim 16, wherein the oil reservoir is positioned at a side of the passenger's area.

20. A watercraft having a hull, a water propulsion device supported by the hull, a four cycle internal combustion engine supported by the hull and being configured to drive the water propulsion device, the water propulsion device comprising a propulsion passage having defined by the hull, an outlet through which water is expelled from the propulsion passage, an impeller positioned in the passage configured to move the water therethrough, an oil reservoir configured to contain lubricant for the engine and being supported by the hull independently of and at a location spaced longitudinally from the engine, the reservoir being positioned on the hull in a position where air will flow in proximity to the oil reservoir as the watercraft travels, and a circulation system configured to circulate lubricant from the oil reservoir through the engine and to return the lubricant to the oil reservoir.

21. A watercraft having a hull, a water propulsion device supported by the hull, a four cycle internal combustion engine supported within an engine compartment of the hull and being configured to drive the water propulsion device, the water propulsion device comprising a propulsion passage having defined by the hull, an outlet through which water is expelled from the propulsion passage, an impeller positioned in the passage configured to move the water therethrough, a lubrication loop including a lubricant reservoir, at least one lubricant gallery defined within the engine, a lubricant supply path extending between the engine and the lubricant reservoir, a lubricant return path extending between the engine and the lubricant reservoir, and at least one pump configured to circulate lubricant through the lubrication loop, at least a portion of the lubrication loop being positioned such that a flow of air will pass over the at least one portion of the lubrication loop as the watercraft travels.

22. The watercraft according to claim 21, wherein the at least one portion of the lubrication loop comprises the lubricant reservoir being spaced longitudinally from the engine.

23. The watercraft according to claim 22, wherein the reservoir is positioned on a deck portion of the hull.

24. The watercraft according to claim 22, wherein the reservoir is positioned near a steering handle.

25. The watercraft according to claim 22, wherein the reservoir is positioned at a side of the passenger's area.

26. The watercraft according to claim 22, wherein the reservoir is positioned beneath a visor mounted on the bow portion of the hull.

27. The watercraft according to claim 21, wherein the lubrication pump is provided at position along the lubricant return path.

28. The watercraft according to claim 21 additionally comprising at least two air inlets configured to direct air into the engine compartment, the at least one portion of the lubrication loop being positioned between the at least two air inlets.

29. The watercraft according to claim 28, wherein the at least one portion of the lubrication loop comprises at least one of the supply path and the return path.

30. The watercraft according to claim 29, wherein at least one of the supply path and the return path comprises at least one hose.

31. The watercraft according to claim 28, wherein at least one of the at least two air inlets is arranged toward a bow of the watercraft, at least a second of the at least two air inlets being arranged toward an aft of the watercraft.

32. A watercraft having a hull with a longitudinal axis, a water propulsion device supported by the hull, a four cycle internal combustion engine including an engine body which defines at least one cylinder having a cylinder axis and including a crankshaft rotatably mounted to rotate about a crankshaft axis, the engine driving the water propulsion device, and a dry-sump lubrication system including a lubricant reservoir and a lubricant filter, the filter being disposed on a front side of the engine, wherein the crankshaft axis extends substantially parallel to the longitudinal axis of the watercraft.

33. The watercraft according to claim 32 additionally comprising at least one pump configured to circulate lubricant between the reservoir, the filter, and the engine.

34. The watercraft according to claim 32, wherein the filter is mounted to the front side of the engine.

35. The watercraft according to claim 32 additionally comprising lateral walls defined by the hull, a seat supported by the lateral walls, and an engine compartment defined at least in part by the lateral walls, the filter being mounted to the front side of the engine.

* * * * *

UNITED STATES PATENT AND TRADEMARK OFFICE

CERTIFICATE OF CORRECTION

PATENT NO. : 6,533,624 B1
DATED : March 18, 2003
INVENTOR(S) : Masayoshi Nanami et al.

It is certified that error appears in the above-identified patent and that said Letters Patent is hereby corrected as shown below:

Column 9,
Line 37, please change “waters” to -- water --.

Signed and Sealed this

Fourteenth Day of October, 2003

JAMES E. ROGAN
*Director of the United States Patent and Trademark Office*